US006065600A

United States Patent [19]

Chen

[11] Patent Number: 6,065,600

[45] Date of Patent: May 23, 2000

[54] PLATE

[76] Inventor: Hsing-Yi Chen, P.O. Box 90, Tainan City, Taiwan

[21] Appl. No.: 09/312,842

[22] Filed: May 17, 1999

[51] Int. Cl.[7] ..... B65D 73/00

[52] U.S. Cl. ..... 206/457; 220/574; 62/457.6; 362/124; 362/806

[58] Field of Search ..... 62/457.6; 200/457, 200/458, 574; 362/806, 808, 124

[56] References Cited

U.S. PATENT DOCUMENTS

| | | | |
|---|---|---|---|
| 3,791,550 | 2/1974 | Duncan | 206/457 |
| 4,753,346 | 6/1988 | Tsuji | 206/457 |
| 4,899,881 | 2/1990 | Girard et al. | 206/457 |
| 4,909,391 | 3/1990 | Newarski | 206/457 |
| 4,950,196 | 8/1990 | Fortune et al. | 206/487 |
| 5,269,717 | 12/1993 | Tardif | 206/457 |
| 5,441,149 | 8/1995 | Willard et al. | 206/457 |

*Primary Examiner*—Joseph M. Moy

[57] ABSTRACT

A plate includes a plate body, a decorative member and a decorative small plate respectively combined on the plate body separably. The decorative member has a base for containing a light emitting device to emit flickering light through holes in its wall. Dry ice may be placed under the decorative member in a recess for the decorative member to fit and stand on the plate body, producing smoke like mist rising up and dispersing through the holes of its wall. Then the plate is placed with food on its upper surface, with light flickering and smoke like mist slowly rising up, enhancing pleasing romantic atmosphere during dining. Further, the decorative small plate may be taken off the plate body for serving a small amount of food, and separable together with the decorative member from the plate body for convenience of storing and packaging.

5 Claims, 4 Drawing Sheets

PLATE

BACKGROUND OF THE INVENTION

This invention relates to a plate, particularly to one provided with a decorative member and a decorative small plate, forming a decorative plate with dry ice put in a recess of the plate body to produce slowly rising smoke like mist and with a light emitting device emitting flickering light to be seen through holes, and thus enhancing pleasing romantic atmosphere during dining. In addition, the decorative small plate may be taken off the plate body and used for serving a small amount of food. And the decorative plate and the decorative member are separable from the plate body for convenience of packaging and storing.

Generally a large plate is used for serving food such as vegetable, fish, meat in a feast, with sculptured vegetable or fruit placed on the large plate for decorating to stimulate appetite of diners (guests). Sometimes, dry ice may be put on the plate, producing slowly rising smoke like mist, making mysterious atmosphere for enhancing dining pleasure. But dry ice may mix liquid food to be eaten together, resulting in harm to health. Besides, the decorative vegetable or fruit sculptures and decorative trinkets are discarded after one time of use, forming garbage, with decorative trinkets made of plastic polluting environment.

SUMMARY OF THE INVENTION

This invention has been devised to offer a plate provided with a decorative member and a decorative small plate combined separably with and standing on the plate body. The plate body has a recess for putting dry ice therein, and a light emitting device for emitting flickering light is contained in the decorative member. The decorative small plate may be taken off for serving a small amount of food separately, and separable from the plate body together with the decorative member for convenience of storing and packaging.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
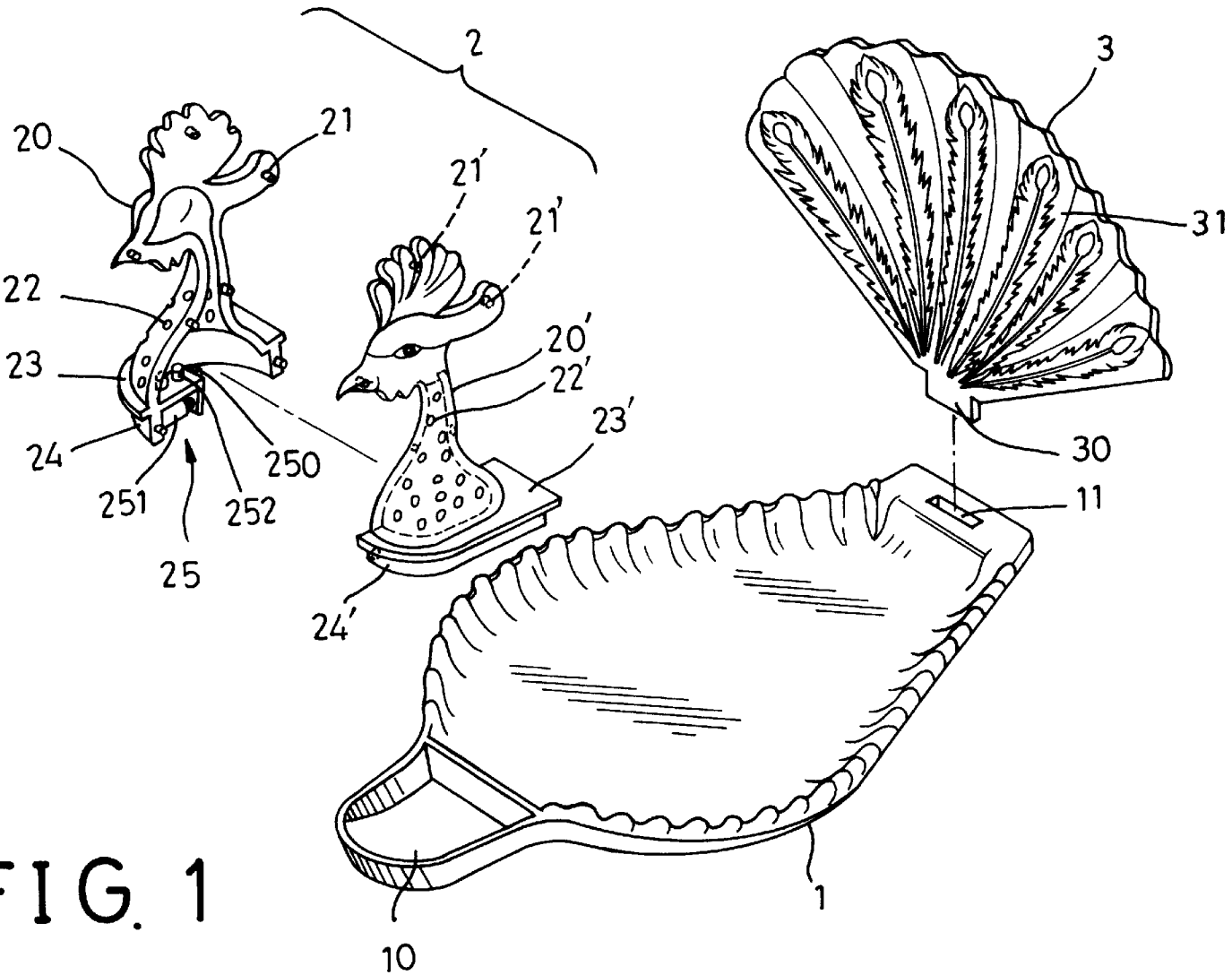
FIG. 1 is an exploded perspective view of a plate in the present invention.

A preferred embodiment of a plate in the present invention, as shown in FIG. 1, includes a plate body 1, a decorative member 2 separably combined with the plate body 1, a decorative small plate 3 also separably combined with the plate body 1.

The plate body 1 has a recess 10 formed in a first end portion for placing dry ice therein and also for the decorative member 2 to combine and stand on the plate body, and an insert slot 11 formed in a second end portion for the decorative small plate 3 to combine and stand on the plate body 1.

The decorative member 2 is formed of two half housings 20, 20', which form a hollow interior after combined together and having a plurality of holes 22, 22' in their walls, and a base 23, 23' formed in a lower portion and having a circumferential contact edge 24, 24'. Further, a light emitting device 25 is fixed inside the base 23, 23', consisting of a switch 250, a battery 251, and a light emitter 252.

The decorative small plate 3 has a projection 30 at a lower end for inserting in the insert slot 11 to stand on the plate body 1 and a curved-in surface 31 for receiving food thereon.

Figure 2:
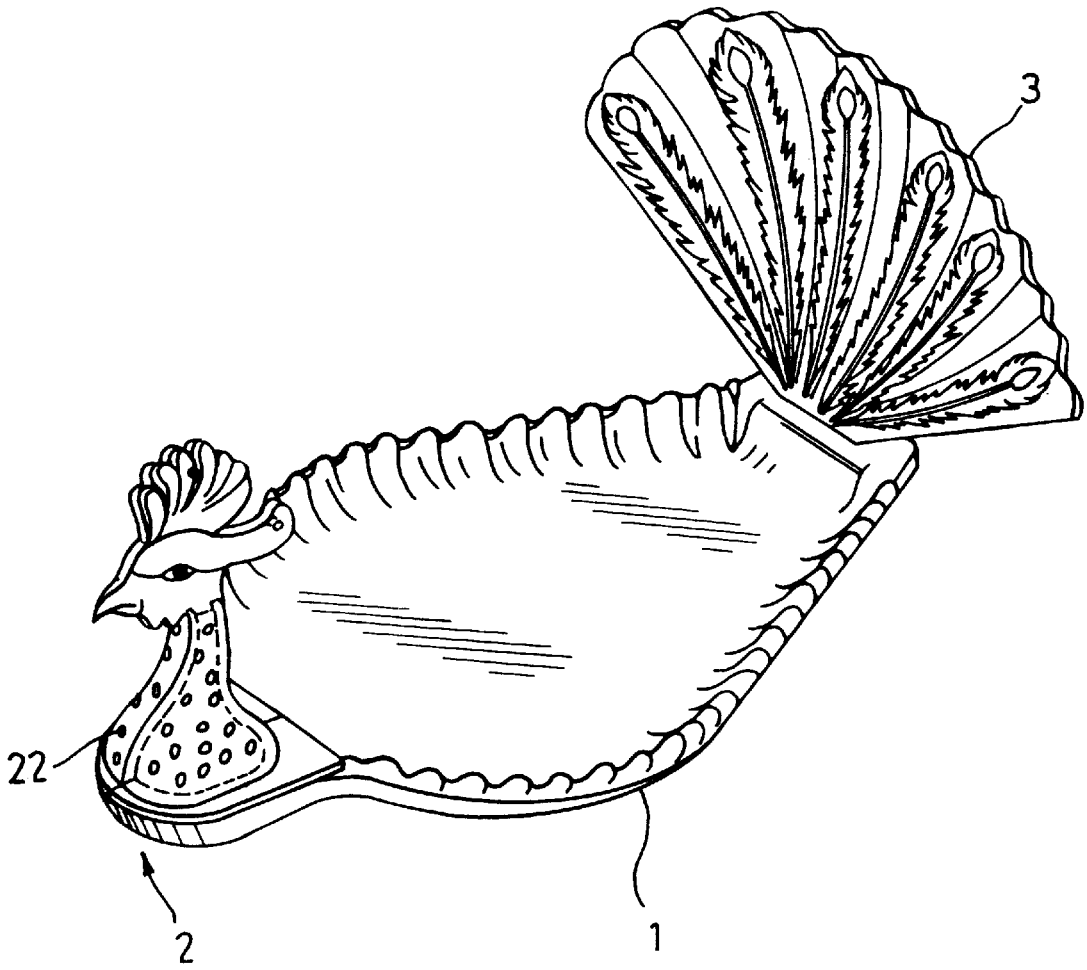
FIG. 2 is a perspective view of the plate in the present invention.

In assembling, as shown in FIGS. 1 and 2, the two half housings 20, 20' are combined with each other, with the projections 21 engaging the holes 21', forming the decorative member 2. Then the base 23, 23' combined together may be inserted in the recess 11 of the plate body 1, standing upright. Next, the decorative small plate 3 has its projection 30 inserted in the insert slot 11 of the plate 1, combined with and stand on the plate body 1 to form a kind of decoration.

Figure 3:
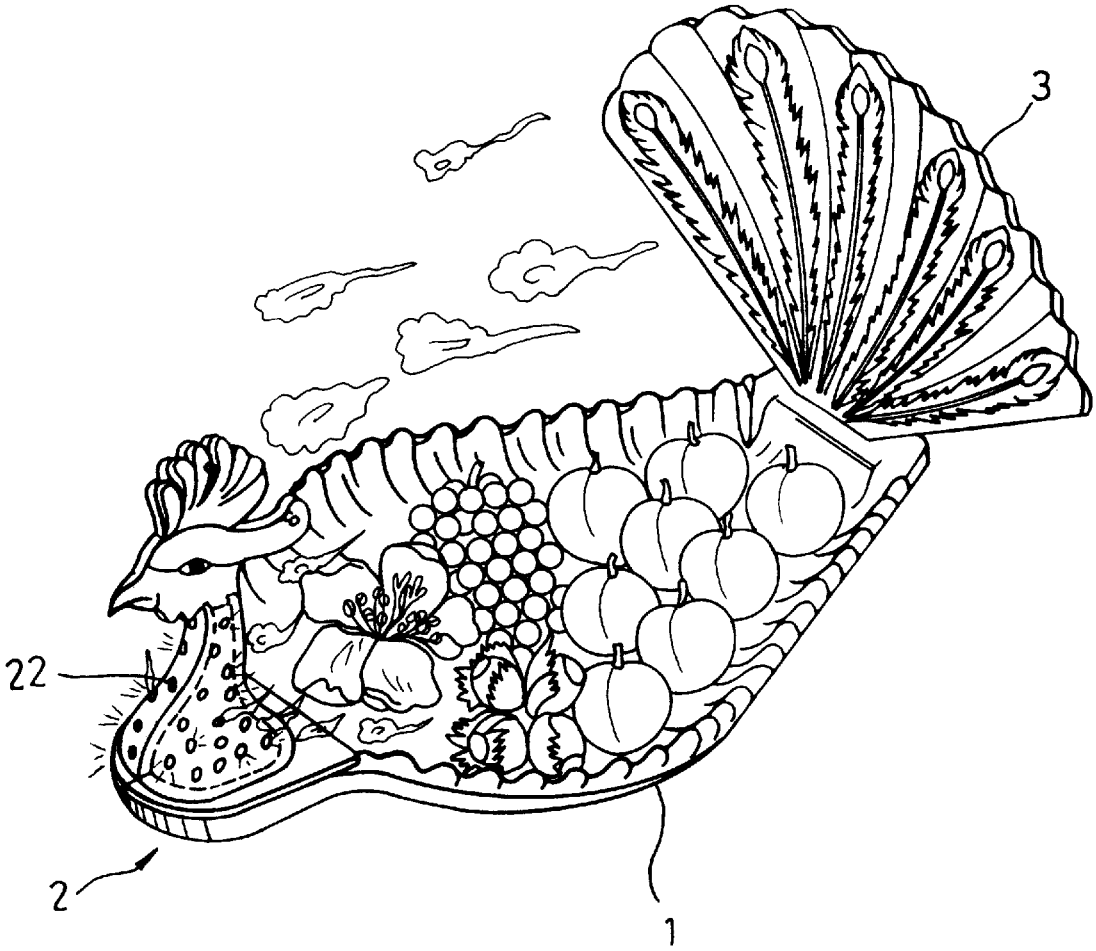
FIG. 3 is a perspective view of the plate placed with food in the present invention.
Figure 4:
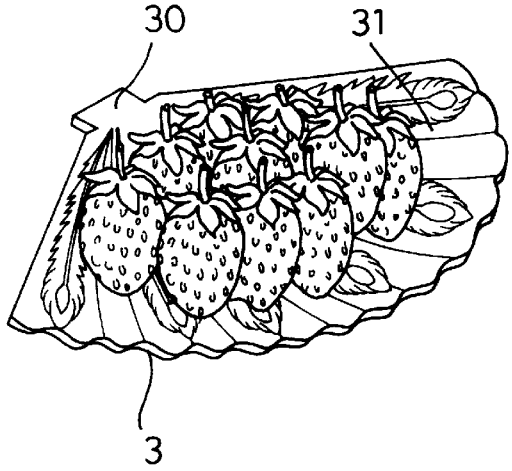
FIG. 4 is a perspective view of a decorative small plate of the plate used for placing food in the present invention; and, FIG. 5 is a perspective view of the plate collapsed in the present invention.
Figure 5:
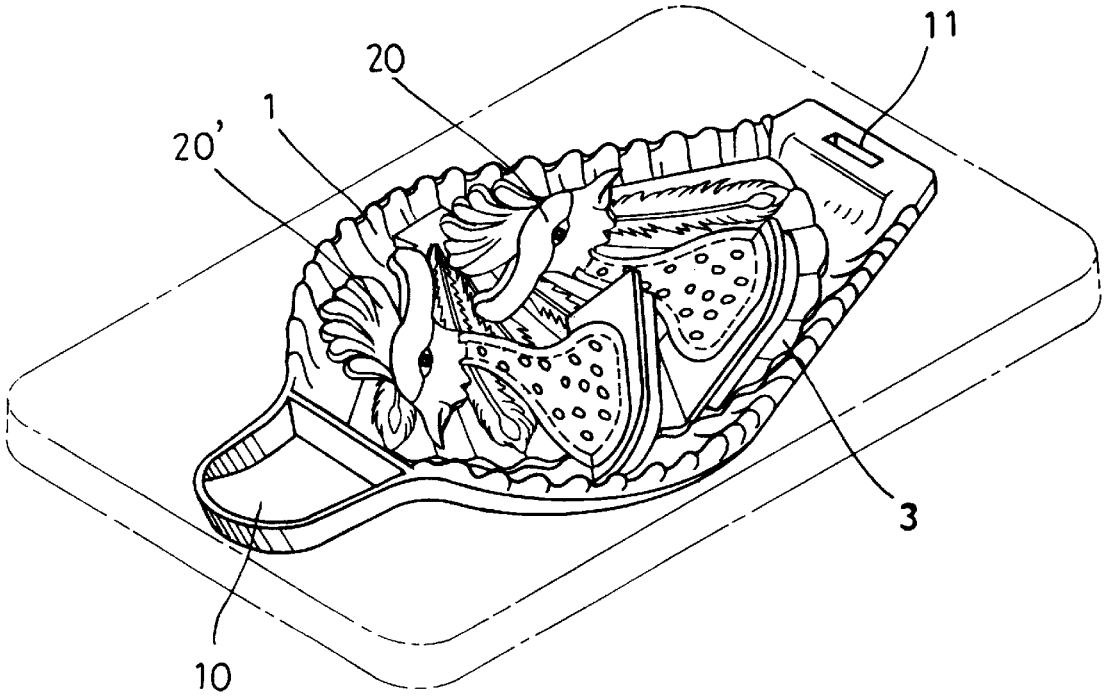

In using, referring to FIG. 3, cooked food or fruit is arranged on the upper surface of the plate body 1, and dry ice is to be put in the recess 10 under the decorative member 2, and then the switch 250 of the light emitting device 25 is turned on to light up the light emitter 252. Thus smoke like mist may be produced by and rise up from the dry ice through the holes 22, 22' of the housing of the decorative member 2, dispersing to and fro, forming an image of weak flickering light and slowly rising mist to enhance pleasing romantic atmosphere during dining. Then the plate body 1 is not needed to add any decorations, and can be repeatedly used, saving cost for would-be-discarded decorative trinkets and not polluting environment. In addition, the decorative small plate can be taken off the plate body 1, usable for serving a small amount of food, too, for example, canned scallop or spiral shell, pickle, appetizer, etc.

Further, an audio device for playing music may be fixed inside the base 23, to coordinate with the light emitting device 25 and dry ice for producing the best romantic atmosphere for dining.

The decorative member 2 and the decorative small plate 3 are separable from the plate body 1, and placed on the upper surface of the plate body 1 for convenience of storing and packaging.

The plate in the invention has the following advantages, as can be seen from the above description.

1. No additional decorations are needed, as the decorative member and the decorative small plate are provided with the plate body.
2. Smoke like mist slowly rising from dry ice placed in the recess of the plate body and weak flickering light emitted from the light emitting device with music coming from the audio device may augment pleasing romantic atmosphere during dining.
3. The decorative small plate can be taken off the plate for serving a small amount of food, having both a decorative and practical use.
4. The decorative member and the decorative small plate are separable from the plate, saving space for storing and packaging.
5. The decorative member and the decorative small plate of different shapes may be prepared and changeable for presenting different outer looking.

While the preferred embodiment of the invention has been described above, it will be recognized and understood that various modifications may be made therein and the appended claims are intended to cover all such modifications which may fall within the spirit and scope of the invention.

What is claimed is:

1. A plate comprising:

a plate body having a recess formed in a first end portion and an insert slot formed in a second end portion;

a decorative member having a base provided with a circumferential contact edge to fit in said recess of said plate body to stand on said plate body, plural holes in its wall, a hollow interior, and a light emitting device fixed in said base;

a decorative small plate having an insert projection formed at a lower end and inserted in said insert hole of said plate body to let said small plate to stand on said plate body, and a curved-in surface formed in an upper surface for serving food; and, said plate body combined with said decorative member and said decorative small plate to form a decorative plate, dry ice being placed in said recess and under said decorative member and producing smoke like mist slowly rising up to disperse out of said holes of said decorative member, said light emitting device being turned on to emit weak flickering light to be seen through said holes of said decorative member so as to enhance pleasing romantic atmosphere during dining, said decorative small plate taken off said plate body for food to be placed on for serving independent food, and said decorative member and said decorative small plate being separable from said plate body for convenience of storing and packaging.

2. The plate as claimed in claim 1, wherein different shapes of said decorative member and said decorative small plate are prepared to be combined with said plate body one at a time to make a different shaped plate.

3. The plate as claimed in claim 1, wherein said decorative member is formed with two half housings combined together with a projection and a hole respectively provided in each said half housing to engage with each other.

4. The plate as claimed in claim 1, wherein said light emitting device fixed in said decorative member consists of a switch, a battery, and a light emitter emitting flickering light of single or multiple colors.

5. The plate as claimed in claim 1, wherein an audio device is further fixed in said base of said decorative member to produce music to coordinate with light produced by said light emitting device.

* * * * *